US006946242B2

(12) United States Patent
Looney

(10) Patent No.: US 6,946,242 B2
(45) Date of Patent: Sep. 20, 2005

(54) METHOD FOR MAINTAINING THE VIABILITY OF SPERM

(75) Inventor: Gregory L. Looney, Warm Springs, GA (US)

(73) Assignee: The United States of America as represented by the Secretary of the Department of the Interior, Washington, DC (US)

( * ) Notice: Subject to any disclaimer, the term of this patent is extended or adjusted under 35 U.S.C. 154(b) by 233 days.

(21) Appl. No.: 10/425,836

(22) Filed: Apr. 30, 2003

(65) Prior Publication Data

US 2004/0219506 A1 Nov. 4, 2004

(51) Int. Cl.[7] ..... B01F 11/00

(52) U.S. Cl. ..... 435/2; 366/208; 366/211; 366/237

(58) Field of Search ..... 366/208–211, 237, 366/239, 240, 348; 435/2, 303.1, 303.3

(56) References Cited

U.S. PATENT DOCUMENTS

| | | | | | |
|---|---|---|---|---|---|
| 527,564 | A | * | 10/1894 | Timby | 366/239 |
| 643,094 | A | * | 2/1900 | Hensel | 4/541.1 |
| 1,578,143 | A | * | 3/1926 | Leabo | 366/210 |
| 1,997,400 | A | * | 4/1935 | Wysocki | 366/211 |
| 2,119,883 | A | * | 6/1938 | Legler | 366/239 |
| 2,840,915 | A | | 7/1958 | Drummond, et al. | |
| 3,291,458 | A | * | 12/1966 | Hamm | 366/110 |
| 3,480,015 | A | | 11/1969 | Gonzalez | |
| 3,625,485 | A | * | 12/1971 | Adler | 366/216 |
| 4,027,735 | A | | 6/1977 | Floyd | |
| 4,162,129 | A | * | 7/1979 | Bartholemew, Jr. | 366/211 |
| 4,923,449 | A | | 5/1990 | Toya et al. | |
| 5,026,342 | A | * | 6/1991 | Hammerstedt et al. | 600/35 |
| 5,282,982 | A | | 2/1994 | Wells | |
| 5,918,979 | A | * | 7/1999 | Martin et al. | 366/211 |
| 6,190,913 | B1 | * | 2/2001 | Singh | 435/394 |

OTHER PUBLICATIONS

Browne et al., "Short term storage of cane toad (*Bufo marinus*) gamates" Reproduction (2001) vol. 121, pp. 167–173.*

* cited by examiner

*Primary Examiner*—David Sorkin
(74) *Attorney, Agent, or Firm*—Mark Homer

(57) ABSTRACT

A rocker for extended, refrigerated storage or transport of fish sperm comprising a platform for sperm containers, drive mechanism, a power supply with an on/off switch or rheostat, and water resistant housing. This device imparts continuous rocking motion to the sperm containers so that the sperm is continuously oxygenated, thus increasing the viability of the sperm.

7 Claims, 2 Drawing Sheets

METHOD FOR MAINTAINING THE VIABILITY OF SPERM

FIELD OF THE INVENTION

The present invention relates to a portable rocker for extended, refrigerated storage or transport of fish sperm or other biological products which require continuous oxygenation/aeration or motion (i.e., blood products).

BACKGROUND OF THE INVENTION

Currently, refrigerated fish sperm is stored for short periods, i.e., hours to a few weeks, in a variety of containers. Some of these containers include 50-ml conical centrifuge tubes, freezer storage bags, and miscellaneous plastic storage containers. Once the sperm is placed into these containers, the container with sperm is stored in a refrigerator at 2–4° C. When the sperm is collected in the field on a stream or lake bank, the sperm is stored in a cooler containing wet ice to maintain the temperature close to about 2–4° C. Unless the container is handled after the sperm is introduced, there is no motion imparted to the sperm and no mixing between the sperm and any oxygen or atmospheric air layer above the sperm. This is contrary to how sperm or other biological products would be maintained in nature. In nature the male fish would be in almost constant motion, which would allow for continuous oxygen replenishment from the animal's circulatory system to the testes where the sperm are contained.

The literature concerning fish sperm maintenance, as well as experience, document that repeated or continuous mixing of the sperm in an oxygenated atmosphere improves sperm viability during refrigerated storage. This need is greatest in the field, where collection of fish sperm is often undertaken. However, in the laboratory or commercial storage for aquaculture, the sperm should ideally be aerated or oxygenated during this cold storage period.

Presently, the only known method of oxygenating and mixing the sperm is by manually inverting the sperm containers every twelve hours. This does not provide the continuous mixing and oxygenation of sperm that occurs in vivo.

There are no known devices within the scientific, conservation, or aquaculture community for continuously oxygenating or aerating sperm or other biological materials which require continuous aeration or oxygenation during storage. The only other known devices which are similar, but which are unsuitable for field use, is found in human blood collection and storage.

Among the devices that can be used in blood collection or storage are those described in U.S. Pat. No. 2,840,915 to Drummond et al.; U.S. Pat. No. 4,027,735 to Floyd; U.S. Pat. No. 5,282,982 to Wells; U.S. Pat. No. 3,480,015 to Gonzalez; and U.S. Pat. No. 4,923,449 to Toya et al.

SUMMARY OF THE INVENTION

It is an object of the present invention to overcome the deficiencies in the prior art.

It is another object of the present invention to provide a device for continuously oxygenating sperm or other biological materials in storage.

It is a further object of the present invention to provide a portable device for continuously mixing and oxygenating sperm or other biological materials which require continuous oxygenation, aeration, or mixing.

The rocker of the present invention comprises four major components:

1. a tray or platform for containers holding the biological material;
2. a drive mechanism;
3. a power source, and
4. a water resistant housing.

The rocker of the present invention is preferably operated using a dry cell battery as a power source, which makes it particularly useful in the field, where electric service is generally not available. Alternatively, the battery box and batteries can be replaced by a connection to an electric outlet or to any other source of current to supply power to the device mechanism.

DETAILED DESCRIPTION OF THE INVENTION

The rocker of the present invention includes four main components as noted above, namely, at least one tray or platform to hold containers of the biological material, a drive mechanism, a power source, and a water resistant housing.

For purposes of the present invention, when describing containers or other devices for carrying sperm, it is understood that the containers or other devices can be used for carrying other types of biological materials which require continuous aeration or motion and are not limited to use with sperm.

Figure 1:
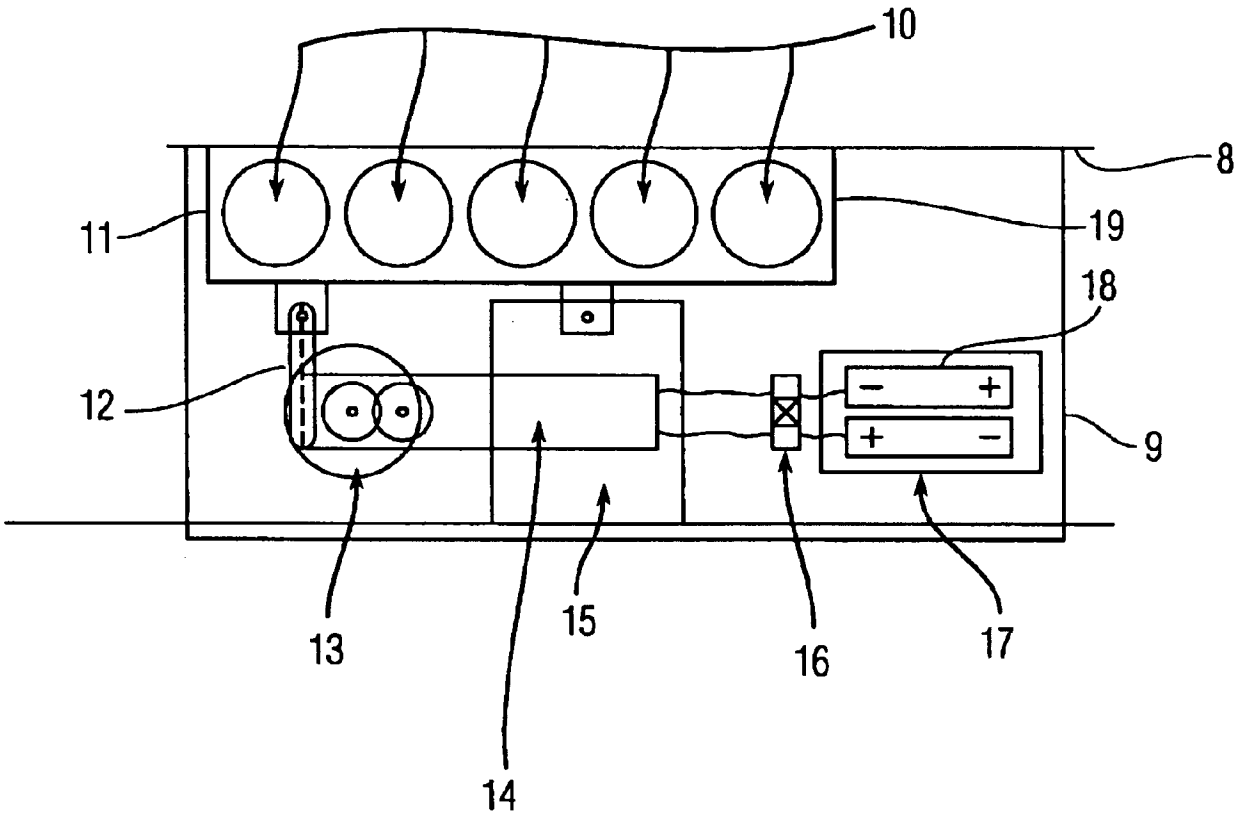
FIG. 1 is a schematic view of a rocker according to the present invention.

Referring to FIG. 1, containers of sperm 10 are placed onto tray 11. A lip or sides 19 surround outer edges of the tray 11 to keep, containers 10 on the tray during rocking motion. DC current is supplied from the replaceable batteries in batter box 17 by turning the switch 16 to the "on" position. Current from the batteries 18 activates a DC motor by supplying power to a gear box 14.

The gear box 14 and the drive wheel 13 convert the rpm of the motor to a ratio that imparts a rocking motion to the tray 11 by way of the drive wheel connecting arm 12.

The entire apparatus is housed in a water and corrosion resistant enclosure 9. The enclosure 9 is supplied with a removable lid 8 to facilitate access to the sperm container tray 11, and the power supply. The entire device can readily be placed into a refrigerator. Alternatively, the device can be placed into a camping/picnic cooler containing ice for use in the field during collection of sperm or other biological material from one location to another.

Figure 2:
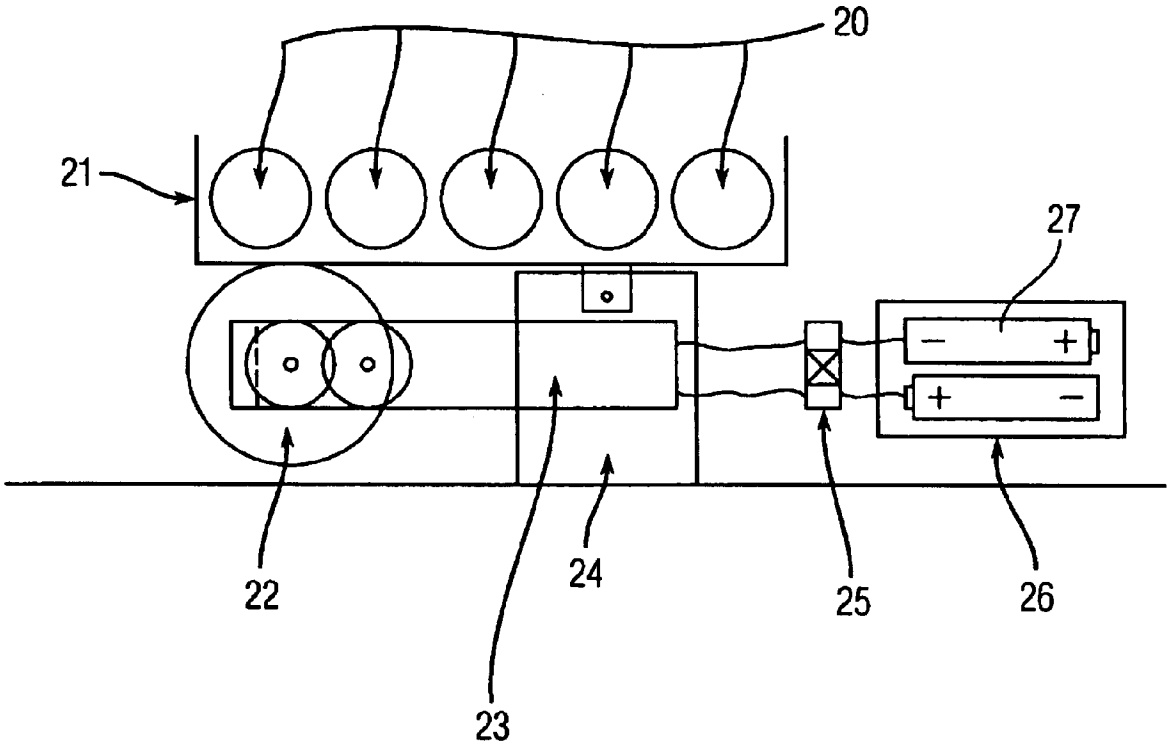
FIG. 2 is a schematic view of another embodiment of a rocker according to the present invention.

FIG. 2 shows another embodiment of the present invention. In this embodiment, containers of sperm 20 are placed onto tray 21. DC current is supplied from the replaceable batteries in battery box 26 by turning the switch 25 to the "on" position. Current from the batteries 27 activates a DC motor by supplying power to a gear box 23. The gear box 23 and the eccentric wheel 22 convert the rpm of the motor to a ratio that imparts a rocking up and down motion to tray 21.

In other embodiments of the invention, the on/off switch is replaced with a rheostat that allows for variation in the current to the motor and therefore the rpm, which makes it possible to adjust the rocking motion (number of rises and falls per minute) of the sperm container tray to allow for optimum performance.

The enclosure for the device can be fabricated from any known water-resistant material, such as Plexiglas. Alternatively, a food-grade plastic container sufficiently large to hold the device can be used.

The device is generally placed into a refrigerator or cooler containing ice to maintain the sperm or other biological material at a temperature of about 2–4° C. However, the device can be equipped with an enclosure that has temperature control supplied by power from a 12 volt auto battery or the like, thus making the device totally self-contained.

The rocker of the present invention provides for continuous mixing and oxygenation of the sperm during storage, which is superior in maintaining sperm viability to prior art devices which required manually inverting the sperm every 12 to 24 hours. The device can be used in the field as well as in the laboratory, since using batteries obviates the need for a source of electrical power. Power in the form of dry cell batteries is readily available, even in remote, out of the way, locations where field collection of fish sperm is often undertaken.

The foregoing description of the specific embodiments of the present invention will so fully reveal the general nature of the invention that others can, by applying current knowledge, readily modify and/or adapt for various applications such specific embodiments without undue experimentation and without departing from the generic concept. Therefore, such adaptations and modifications should and are intended to be comprehended within the meaning and range of equivalents of the disclosed embodiments.

It is to be understood that the phraseology or terminology employed herein is for the purpose of description and not of limitation. The means and materials for carrying out disclosed functions may take a variety of alternative forms without departing from the invention. Thus, the expressions "means to . . . " and "means for . . . " as may be found the specification above, and/or in the claims below, followed by a functional statement, are intended to define and cover whatever structural, physical, chemical, or electrical element or structures which may now or in the future exist for carrying out the recited function, whether or not precisely equivalent to the embodiment or embodiments disclosed in the specification above, and it is intended that such expressions be given their broadest interpretation.

What is claimed is:

1. A method for maintaining the viability of sperm comprising: introducing the sperm into at least one container, placing the at least one container onto a platform or tray, the platform or tray having a lip around outer edges of the platform or tray, supplying from a power source a rocking motion to the container or tray whereby the sperm is aerated, and providing a water resistant housing surrounding the power source, the platform or tray, and the at least one container.

2. The method according to claim 1 wherein the power source comprises a motor, and means for converting rpm of the motor to a rocking motion to the tray or platform.

3. The method according to claim 2 wherein the rocking motion is imparted to the platform or tray by means of a gear box and drive wheel.

4. The method according to claim 2 wherein the rocking motion is imparted to the platform or tray by means of an eccentric wheel.

5. The method according to claim 1 further comprising a plurality of containers placed on the platform or tray.

6. The method according to claim 5 wherein the water resistant housing further comprises a temperature control means.

7. The method according to claim 1 wherein the power source comprises at least one dry cell battery.

* * * * *